US011581154B2

(12) United States Patent
Causey et al.

(10) Patent No.: US 11,581,154 B2
(45) Date of Patent: Feb. 14, 2023

(54) BATTERY LOCK OUT FOR POWER TOOL

(71) Applicant: TECHTRONIC CORDLESS GP, Anderson, SC (US)

(72) Inventors: Brandon Causey, Greenville, SC (US); Isiah D. Smith, Greenville, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 366 days.

(21) Appl. No.: 16/892,803

(22) Filed: Jun. 4, 2020

(65) Prior Publication Data

US 2020/0388451 A1 Dec. 10, 2020

Related U.S. Application Data

(60) Provisional application No. 62/858,475, filed on Jun. 7, 2019.

(51) Int. Cl.
*H01H 15/10* (2006.01)
*B25F 5/02* (2006.01)

(52) U.S. Cl.
CPC ..... *H01H 15/10* (2013.01); *B25F 5/02* (2013.01); *H01H 2221/014* (2013.01); *H01H 2231/048* (2013.01)

(58) Field of Classification Search
CPC ..... H01H 15/10; H01H 2221/014; H01H 2231/048; H01H 3/20; H01H 9/063; H01H 2009/065; B25F 5/02
See application file for complete search history.

(56) References Cited

U.S. PATENT DOCUMENTS

| | | | |
|---|---|---|---|
| 3,212,188 | A | 10/1965 | Riley, Jr. et al. |
| 3,212,938 | A | 10/1965 | Neuhardt et al. |
| 6,075,341 | A | 6/2000 | White et al. |
| 6,181,032 | B1 | 1/2001 | Marshall et al. |
| 6,534,885 | B2 | 3/2003 | Nakagawa et al. |
| 6,742,601 | B2 | 6/2004 | Numata |

(Continued)

FOREIGN PATENT DOCUMENTS

| | | | |
|---|---|---|---|
| CN | 102990620 | A | 3/2013 |
| CN | 202985528 | U | 6/2013 |

(Continued)

*Primary Examiner* — Lheiren Mae A Caroc
(74) *Attorney, Agent, or Firm* — Michael Best & Friedrich LLP

(57) ABSTRACT

A power tool includes an electric motor, an output member selectively driven by the electric motor and a battery receptacle configured to receive a battery. The power tool also includes a switch trigger moveable between a first position and a second position. The switch trigger inhibits electrical communication between the battery and the electric motor while the switch trigger is in the first position. The switch trigger operates a switch to provide electrical communication between the electric motor and the battery while the switch trigger is in the second position. A lock actuator prevents movement of the switch trigger to the second position while the lock actuator is in a locked position, and the lock actuator permits movement of the switch trigger to the second position while in an unlocked position. The lock actuator is biased into the unlocked position while the battery is positioned in the receptacle.

20 Claims, 5 Drawing Sheets

(56) References Cited

U.S. PATENT DOCUMENTS

| | | | | |
|---|---|---|---|---|
| 6,933,689 | B2 | 8/2005 | Yamamoto | |
| 7,261,166 | B2 * | 8/2007 | Baber | B25F 5/02 200/522 |
| 7,638,233 | B2 | 12/2009 | Vettoretti et al. | |
| 7,682,726 | B2 | 3/2010 | Rejman et al. | |
| 7,887,942 | B2 | 2/2011 | Rejman et al. | |
| 7,997,352 | B2 | 8/2011 | Hashimoto et al. | |
| 8,129,046 | B2 | 3/2012 | Corder | |
| 8,198,835 | B2 | 6/2012 | Yokoyama et al. | |
| 8,410,756 | B2 | 4/2013 | Sakakibara et al. | |
| 8,813,866 | B2 | 8/2014 | Suzuki | |
| 8,984,711 | B2 | 3/2015 | Ota et al. | |
| 9,041,322 | B2 | 5/2015 | Shimizu et al. | |
| 9,583,746 | B2 | 2/2017 | Ota et al. | |
| 9,780,582 | B2 | 10/2017 | Schmid et al. | |
| 9,923,249 | B2 | 3/2018 | Rejman et al. | |
| 2004/0081882 | A1 | 4/2004 | Ontl | |
| 2007/0102268 | A1 * | 5/2007 | Hofmann | H01R 13/7036 200/43.11 |
| 2017/0043457 | A1 | 2/2017 | Tsuge | |
| 2017/0125754 | A1 | 5/2017 | Ota et al. | |

FOREIGN PATENT DOCUMENTS

| | | | |
|---|---|---|---|
| WO | 2012005159 | A1 | 1/2012 |
| WO | 2014148452 | A1 | 9/2014 |
| WO | 2018079723 | A1 | 5/2018 |

* cited by examiner

BATTERY LOCK OUT FOR POWER TOOL

CROSS-REFERENCE TO RELATED APPLICATION

This application claims the benefit of U.S. Provisional Patent Application No. 62/858,475, filed Jun. 7, 2019, the entire contents of which are incorporated by reference.

BACKGROUND

The present disclosure relates to a battery powered power tool and, more specifically to a mechanism that limits operation of a user input member while a battery is uncoupled from a power tool.

SUMMARY

In one independent aspect, a power tool includes an electric motor, an output member selectively driven by the electric motor and a battery receptacle configured to receive a battery. The power tool also includes a switch trigger moveable between a first position and a second position. The switch trigger inhibits electrical communication between the battery and the electric motor while the switch trigger is in the first position. The switch trigger operates a switch to provide electrical communication between the electric motor and the battery while the switch trigger is in the second position. The power tool also includes a lock actuator movable between a locked position and an unlocked position. The lock actuator prevents movement of the switch trigger to the second position while the lock actuator is in the locked position. The lock actuator permits movement of the switch trigger to the second position while in the unlocked position. The lock actuator is biased into the unlocked position while the battery is positioned in the receptacle.

In another independent aspect, a power tool is provided including a slide switch, a switch trigger, and a lock actuator. The switch trigger is coupled to the slide switch and selectively movable between a first position in which the slide switch is in an OFF position and a second position in which the slide switch is in an ON position. The lock actuator is supported for movement between a locked position and an unlocked position. The lock actuator prevents movement of the switch trigger to the second position while the lock actuator is in the locked position. The lock actuator permits movement of the switch trigger to the second position while the lock actuator is in the unlocked position. The lock actuator is moved to the unlocked position in response to a battery being positioned in a battery receptacle of the power tool.

In yet another independent aspect, a power tool includes an electric motor, an output member selectively driven by the electric motor, a battery receptacle configured to receive a battery, a switch trigger movable between a first position and a second position, and a lock actuator movable between a locked position and an unlocked position. The switch trigger inhibits electrical communication between the battery and the electric motor while the switch trigger is in the first position, and the switch trigger operates a switch to provide electrical communication between the electric motor and the battery while the switch trigger is in the second position. The lock actuator is positioned in the locked position while no battery is positioned in the battery receptacle, and the lock actuator prevents movement of the switch trigger to the second position while the lock actuator is in the locked position. The lock actuator is positioned in the unlocked position while a battery is positioned in the battery receptacle and permits movement of the switch trigger to the second position.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to an actuator mechanism for a power tool. The actuator mechanism may limit the movement of a switch when a battery is not coupled to the power tool.

FIGS. 1-4 illustrate a battery powered power tool, generally designated 10. The power tool 10 includes a mechanical and electrical actuator mechanism, generally designated 30. FIG. 5 illustrates a battery powered power tool 10A according to another embodiment. The power tool 10A includes a purely mechanical actuator mechanism 30A. At least some differences and similarities between the power tool 10 and the power tool 10A are described below. Similar features are identified by similar reference numbers, where possible.

Figure 1:
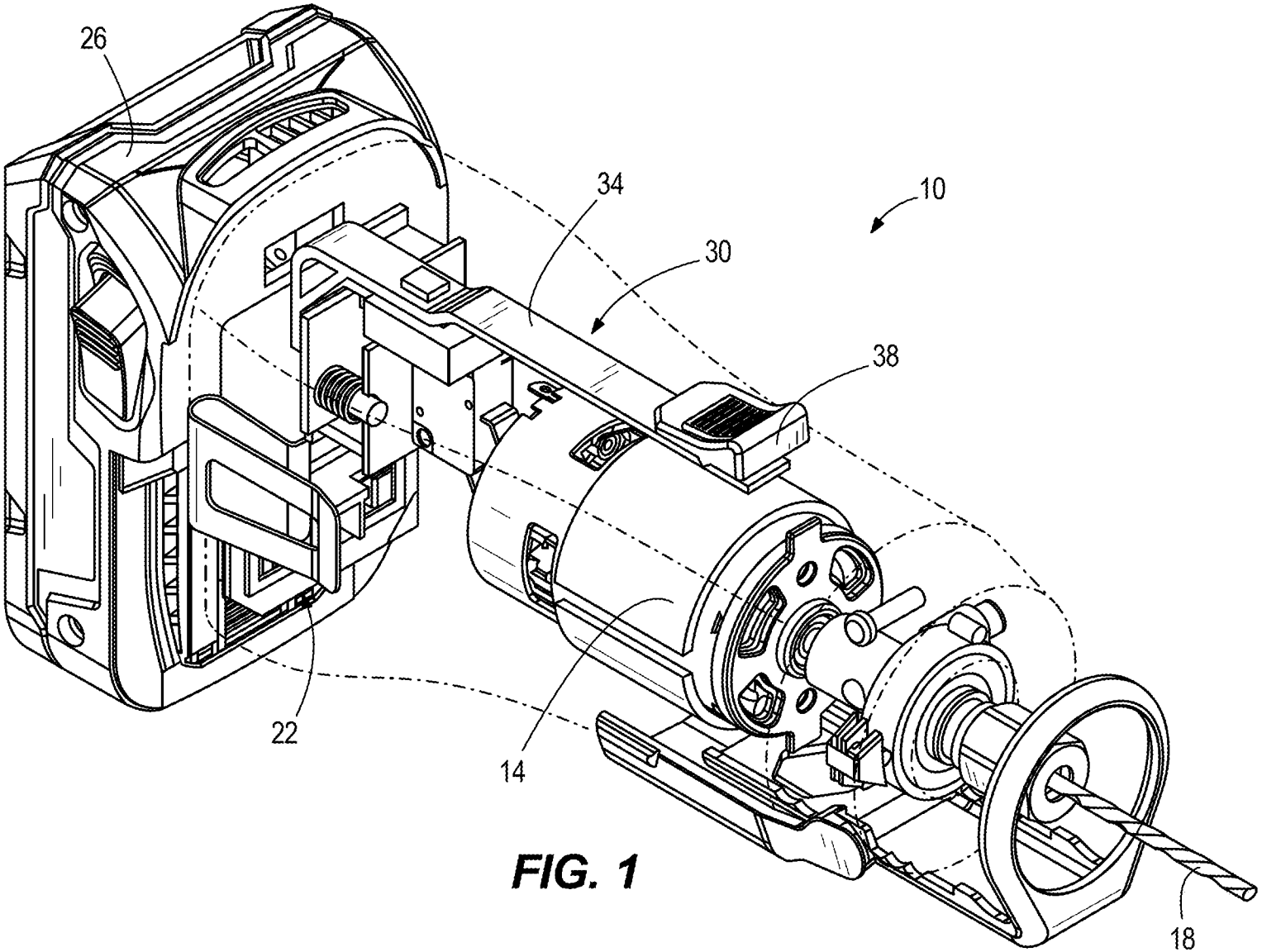
FIG. 1 is a perspective view of a battery powered power tool.

As shown in FIG. 1, the power tool 10 includes a motor 14 (e.g., an electric motor) and an output member 18 operatively coupled to the motor 14. The motor 14 may selectively drive the output member 18 to move (e.g., rotate, translate, and/or the like). The power tool 10 also includes a receptacle 22 that selectively receives a battery 26 (e.g., a power tool battery pack). The battery 26 may provide electrical current to the motor 14 while the battery 26 is coupled to the receptacle 22. In the illustrated embodiment, the power tool 10 is a cutting tool (e.g., a drill, a saw, and/or the like). In other embodiments, the power tool 10 may be a different type of tool (e.g., an impact driver, a blower, a fan, and/or the like).

The actuator mechanism 30 may be disposed between the motor 14 and the battery 26, and may be actuated by a user. The actuator mechanism 30 may selectively permit current to flow from the battery 26 and to the motor 14 in some instances by completing a circuit between the motor 14 and the battery 26. The actuator mechanism 30 may be moved between a first or ON position (e.g., in which the output member 18 is actuated) and a second or OFF position (e.g., in which the output member 18 is not actuated).

Figure 2:
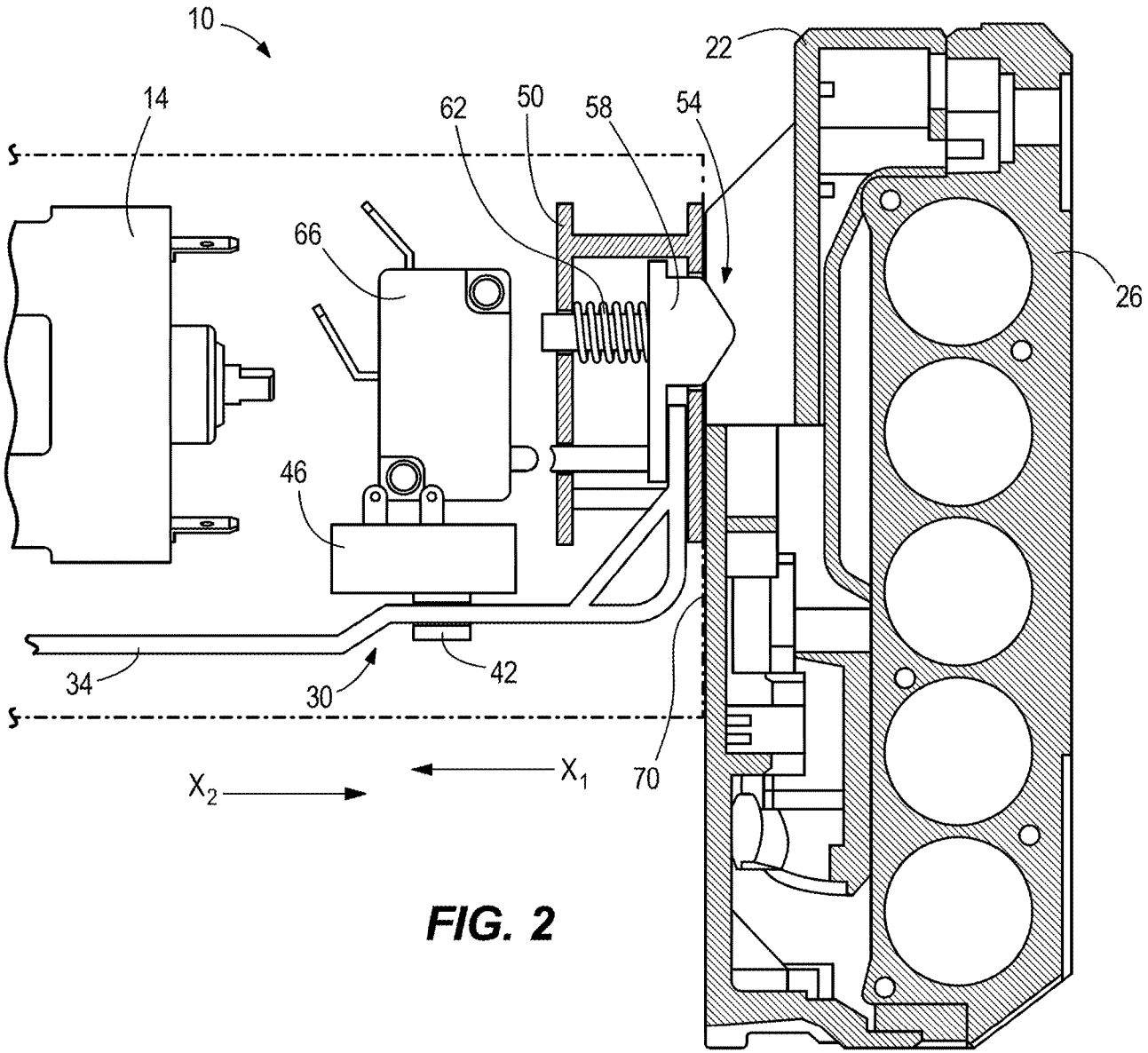
FIG. 2 is an enlarged view of the power tool of FIG. 1, illustrating a battery uncoupled from the power tool and an actuator of an actuating mechanism in a first position.

As shown in FIG. 2, the actuator mechanism 30 includes a switch trigger 34 that is coupled to a user input member 38 (FIG. 1) and a slide switch button 42. The user input member 38 may be coupled to one end of the switch trigger 34 and is accessible to a user (e.g., it is positioned outside a housing of the power tool 10) so that the user may interact with the user input member 38. The slide switch button 42 is coupled to a slide switch 46, which is coupled (e.g., electrically coupled) to the motor 14. In the illustrated embodiment, the switch trigger 34, the user input member 38, and the slide switch button 42 are rigidly coupled together. In other words, the switch trigger 34, the user input member 38, and the slide switch button 42 move (e.g., translate) together so that there is no relative movement between them. The slide switch button 42 moves relative to the slide switch 46 as the switch trigger 34 moves. Other layouts, positions, and/or orientations of the components forming the actuator mechanism 30 are contemplated.

The actuator mechanism 30 may additionally include a frame or ribs 50 disposed proximate the receptacle 22. The switch trigger 34 may rest within at least a portion of the frame 50 in the OFF position, and may move relative to the frame 50. The frame 50 may include a channel 54 proximate to the receptacle 22. An actuator 58 may be positioned within the channel 54 and be movably coupled to the frame 50. A biasing member 62 (e.g., a coil, a spring, and/or the like) may be coupled to the actuator 58 to bias the actuator 58 at least partially into the receptacle 22. The biasing force from the biasing member 62 may cause the actuator 58 to engage the switch trigger 34 against the frame 50 (FIG. 2).

With continued reference to FIG. 2, when the battery 26 is uncoupled from the power tool 10, the actuator 58 is positioned in a locked position or first position and extends partially into the receptacle 22. The actuator 58 also contacts the switch trigger 34. The biasing force of the biasing member 62 limits the translation of the switch trigger 34 in a first direction $X_1$. If a force is applied to the switch trigger 34 (e.g., via the user input member 38), the biasing member 62 would return the actuator 58 and the switch trigger 34 to the first position.

In the illustrated embodiment, the actuator member 30 may also include a micro switch 66. The micro switch 66 is movable between an OFF position (e.g., in which the output member 18 may be inoperable) and an ON position (e.g., in which the output member 18 is operable). Movement of the actuator 58 from the first position to an unlocked position or second position may move the micro switch 66 between the OFF position and the ON position. In the first position, micro switch 66 is spaced apart from the actuator 58, and the micro switch 66 remains in the OFF position (e.g., the output member 18 is unable to move). The biasing member 62 is configured to maintain the spacing between the micro switch 66 and the actuator 58 so that the output member 18 (FIG. 1) does not move while the battery 26 is uncoupled from the power tool 10. In this way, the power tool 10 will not be left in a powered-on state upon removal of a depleted battery and reinsertion of a charged battery. In this way, automatic restart of the power tool 10 is inhibited, and the safety associated with operating the power tool 10 is improved.

Figure 3:
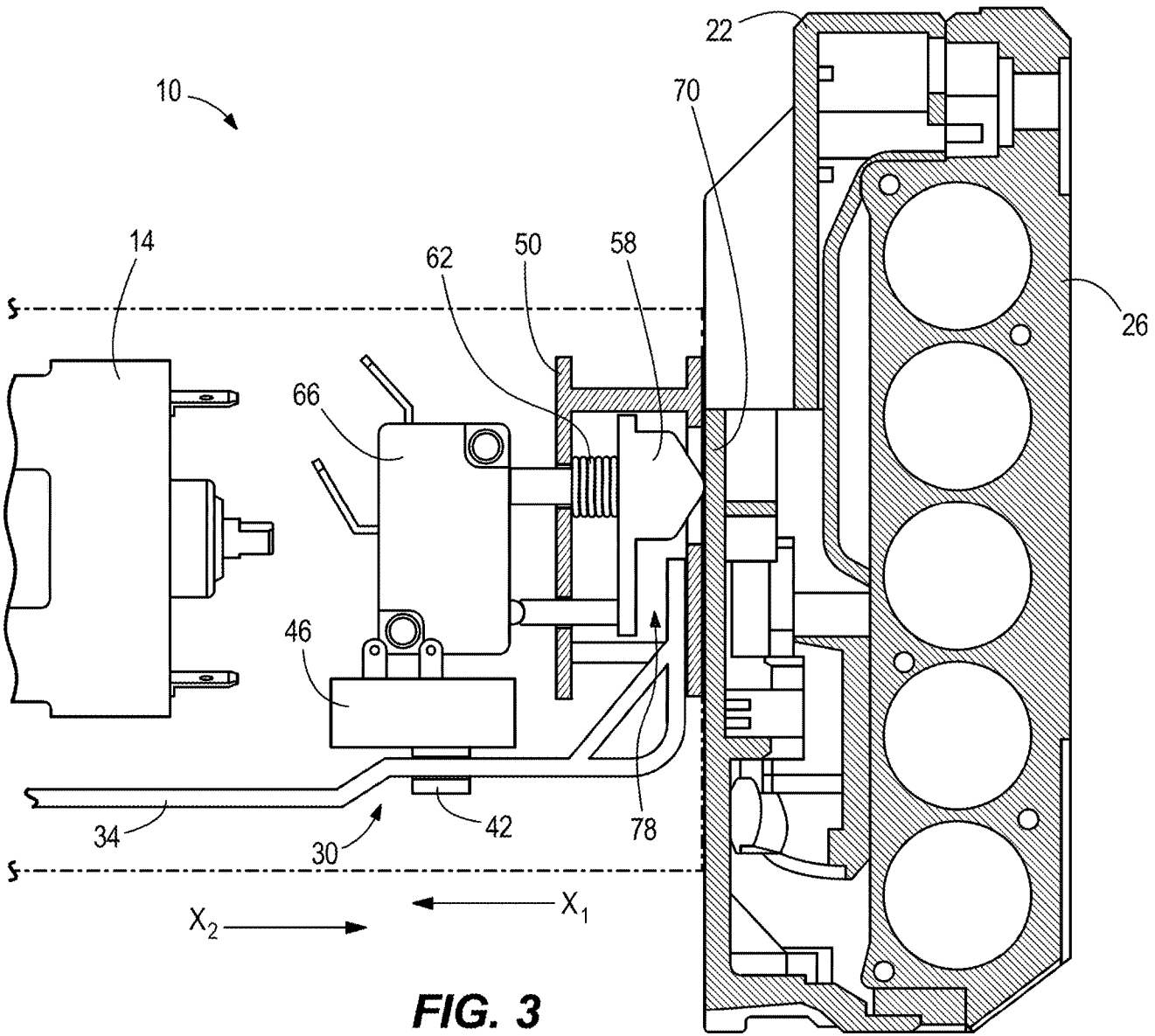
FIG. 3 is an enlarged view of the power tool of FIG. 1, illustrating the battery coupled to the power tool and the actuator in a second position.

As shown in FIG. 3, once the battery 26 is inserted into the receptacle 22 (e.g., when the battery 26 slides upwardly in FIG. 3), a surface 70 of the battery 26 contacts the actuator 58. Contact between the surface 70 and the actuator 58 overcomes the bias of the biasing member 62, and moves the actuator 58 in the first direction $X_1$ into the second position. The actuator 58 engages the micro switch 66 and moves the micro switch 66 into the ON position, which permits operation of the output member 18.

The movement of the actuator 58 away from the switch trigger 34 to the second position forms a gap 78 between the actuator 58 and the switch trigger 34. The gap 78 permits movement of the switch trigger 34 in the first direction $X_1$, while the actuator 58 is in the second position.

Figure 4:
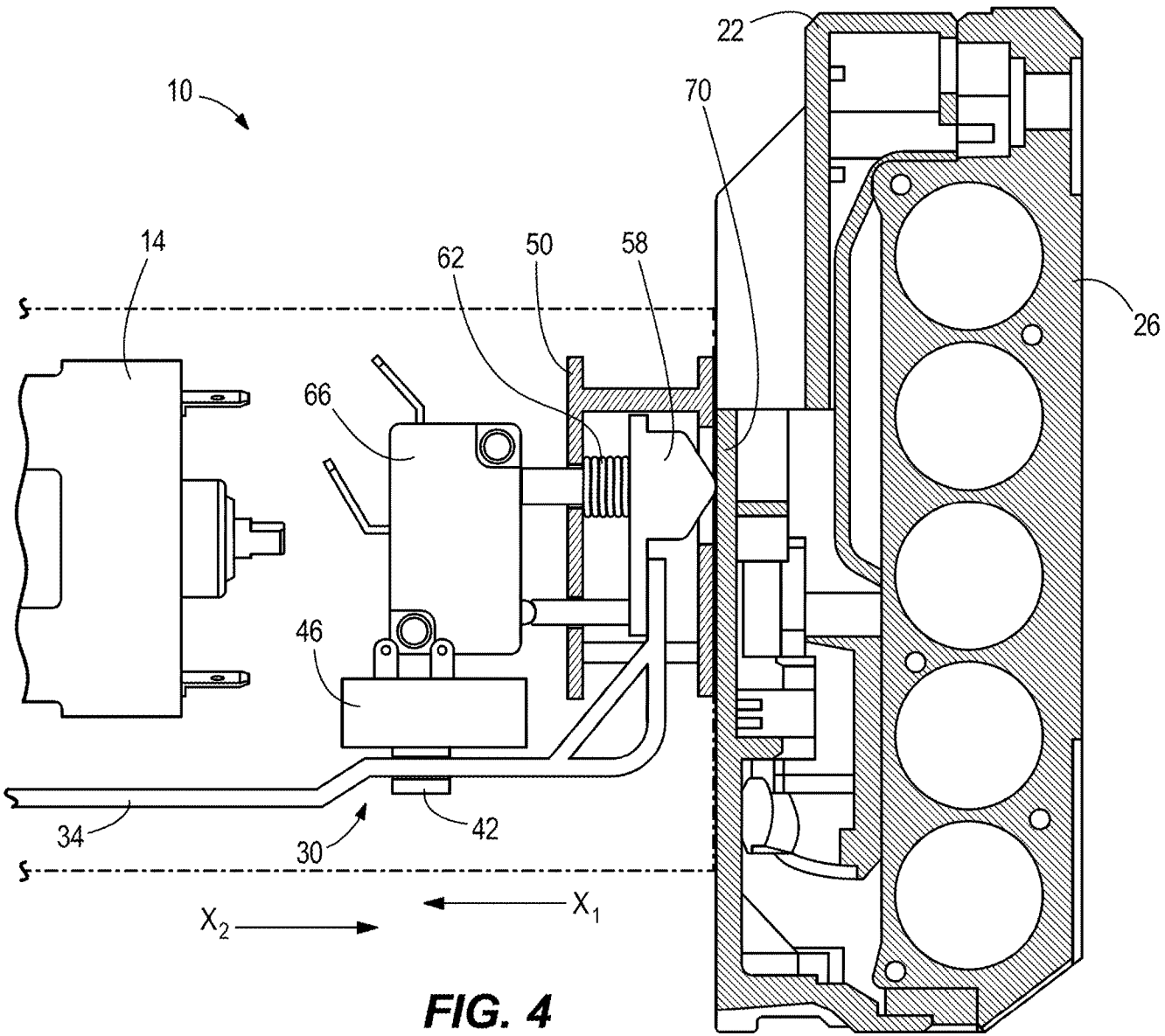
FIG. 4 is an enlarged view of the power tool of FIG. 1, illustrating a switch trigger of the actuator mechanism moving relative to actuator.
Figure 5:
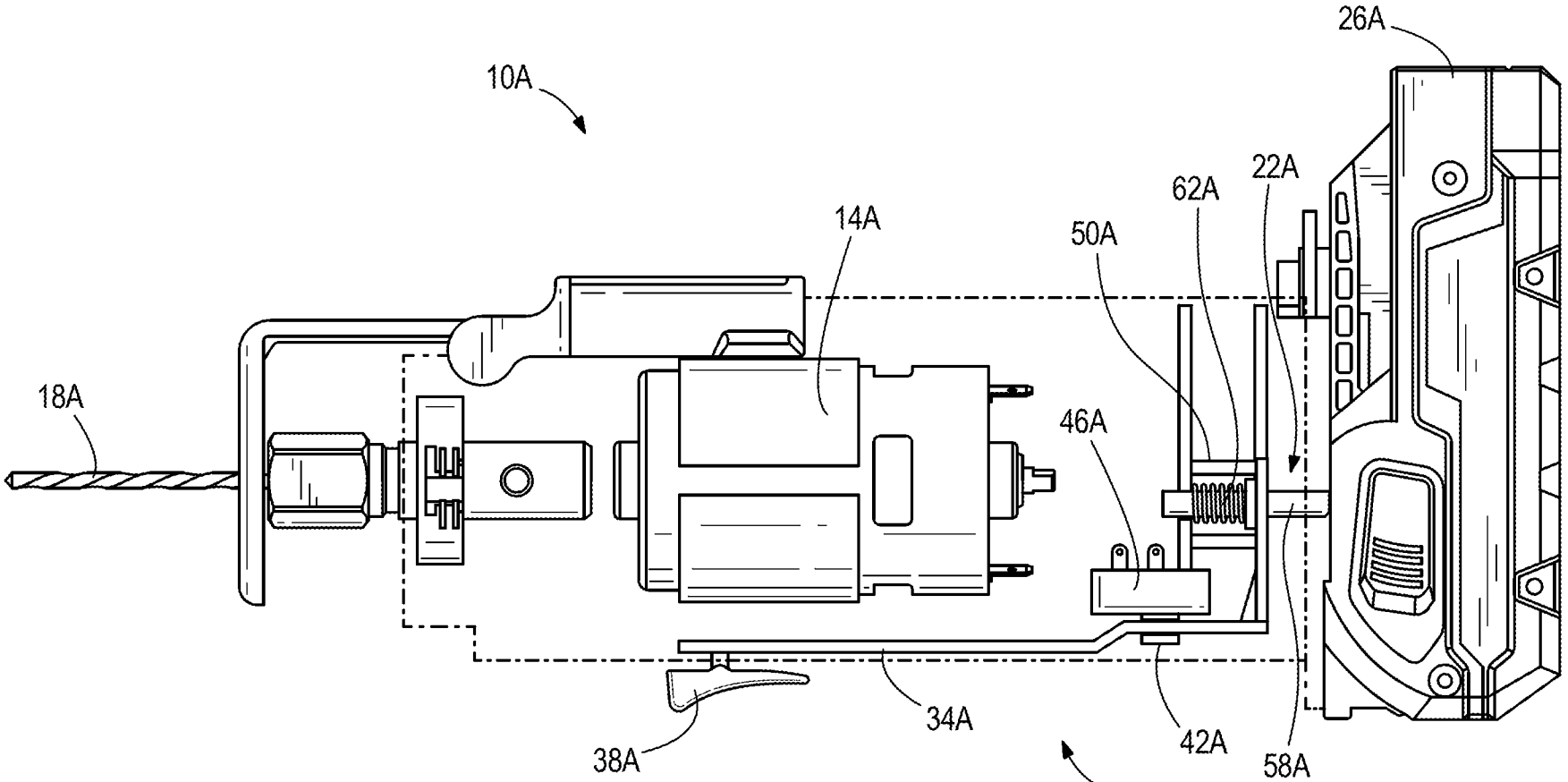
FIG. 5 is another embodiment of a battery powered power tool.

As shown in FIG. 4, once the actuator 58 is in the second position, the user input member 38 may be moved and cause the switch trigger 34 to move relative to the frame 50. Movement of the switch trigger 34 may cause the slide switch button 42 to move relative to the slide switch 46. The slide switch button 42 may turn the slide switch 46 from OFF to ON as the switch trigger 34 moves in the first direction $X_1$. With the slide switch 46 ON, the motor 14 may receive current from the battery 26 in order to drive the output member 18. The actuator 58 provides a stop surface and limits the movement of the switch trigger 34 in the first direction $X_1$. In some embodiments, the switch trigger 34 may be biased in a second direction $X_2$ opposite the first direction when a user releases the user input member 38. In other embodiments, the user moves the user input member 38 in the second direction $X_2$. In either embodiment, the slide switch button 42 returns the slide switch 46 to the OFF position (see e.g., FIG. 3) as the switch trigger 34 moves in the second direction $X_2$. The output member 18 may stop moving when the switch trigger 34 returns to the OFF position.

Once the switch trigger 34 has returned to its initial position in contact with the ribs 50, a user may remove the battery 26 from the receptacle 22. As the battery 26 moves out of the receptacle 22, the surface 70 no longer contacts the actuator 58 (see e.g., FIG. 3). The biasing member 62 returns the actuator 58 to the first position. This causes the actuator 58 to close the gap 78, and engage the switch trigger 34. It also causes the actuator 58 to move away from the micro switch 66 and return the micro switch 66 to the OFF position. The output member 18 may be unable to move even if the switch trigger 34 were able to overcome the biasing force of the biasing member 62. Additionally, if the battery 26 is removed while the switch trigger 34 is actuated (e.g., while the switch trigger 34 moves the slide switch to the ON position), the actuator 58 also moves the switch trigger in the second direction $X_2$, thereby causing the slide switch 46 to move to the OFF position.

As shown in FIG. 5, another embodiment of the power tool 10A includes a purely mechanical actuator mechanism 30A (e.g., the power tool 10A does not include a micro switch). In other words, only the slide switch 46A needs to move to the ON position in order for the output member 18A to move. The actuator mechanism 30A operates in an otherwise substantially similar way as the actuator method 30.

The embodiment(s) described above and illustrated in the figures are presented by way of example only and are not intended as a limitation upon the concepts and principles of the present disclosure. As such, it will be appreciated that variations and modifications to the elements and their configurations and/or arrangement exist within the spirit and scope of one or more independent aspects as described.

What is claimed is:

1. A power tool comprising:

an electric motor;

an output member selectively driven by the electric motor;

a battery receptacle configured to receive a battery;

a switch trigger movable between a first position and a second position, the switch trigger inhibiting electrical communication between the battery and the electric motor while the switch trigger is in the first position, the switch trigger operating a switch to provide electrical communication between the electric motor and the battery while the switch trigger is in the second position; and a lock actuator movable between a locked position and an unlocked position, the lock actuator preventing movement of the switch trigger to the second position while the lock actuator is in the locked position, the lock actuator permitting movement of the switch trigger to the second position while in the unlocked position, and the lock actuator biased into the unlocked position while the battery is positioned in the receptacle.

2. The power tool of claim 1, wherein, while the lock actuator is in the locked position, the lock actuator partially extends within the battery receptacle in the locked position, and the lock actuator is configured to engage the battery while the battery is positioned in the battery receptacle.

3. The power tool of claim 1, wherein the lock actuator is biased toward the locked position by a biasing member.

4. The power tool of claim 1, wherein the switch includes a slide switch operable to selectively provide electrical communication to the motor.

5. The power tool of claim 1, wherein the switch trigger is positioned between the lock actuator and the battery receptacle.

6. The power tool of claim 1, further comprising a micro switch selectively electrically coupled to the output member, wherein movement of the lock actuator between the locked position and the unlocked position moves the micro switch between an OFF position and an ON position.

7. The power tool of claim 1, wherein while the lock actuator is in the locked position, the lock actuator biases the switch trigger toward the receptacle, and while the lock actuator is in the unlocked position, the lock actuator is spaced apart from the switch trigger to permit movement of the switch trigger.

8. The power tool of claim 1, wherein the switch trigger includes a user input button coupled to the switch trigger and operable to move the switch trigger from the first position to the second position.

9. A power tool, comprising:

a slide switch;

a switch trigger coupled to the slide switch and selectively movable between a first position in which the slide switch is in an OFF position, and a second position in which the slide switch is in an ON position; and a lock actuator supported for movement between a locked position and an unlocked position, the lock actuator preventing movement of the switch trigger to the second position while the lock actuator is in the locked position, the lock actuator permitting movement of the switch trigger to the second position while the lock actuator is in the unlocked position, and the lock actuator being moved to the unlocked position in response to a battery being positioned in a battery receptacle of the power tool.

10. The power tool of claim 9, wherein, while the lock actuator is in the locked position, the lock actuator partially extends within the battery receptacle in the locked position, and the lock actuator is configured to engage the battery while the battery is positioned in the battery receptacle.

11. The power tool of claim 9, further comprising a frame adjacent the battery receptacle, wherein the switch trigger is disposed between the lock actuator and the frame.

12. The power tool of claim 11, wherein while the lock actuator is in the locked position the lock actuator biases the switch trigger against the frame, and while the lock actuator is in the unlocked position, the lock actuator is spaced apart from the frame and permits movement of the switch trigger.

13. The power tool of claim 9, further comprising a micro switch moveable between an ON position and an OFF position.

14. The power tool of claim 13, wherein while the lock actuator is in the locked position the micro switch is in the OFF position, and while the lock actuator is in the unlocked position the micro switch is in the ON position.

15. The power tool of claim 9, wherein the switch trigger is biased towards the first position.

16. The power tool of claim 9, wherein a trigger button is coupled to the switch trigger and is operable to move the switch trigger between the initial position and the secondary position.

17. The power tool of claim 9, wherein the lock actuator is biased toward the locked position when the battery is uncoupled from the battery receptacle.

18. A power tool comprising:

an electric motor;

an output member selectively driven by the electric motor;

a battery receptacle configured to receive a battery;

a switch trigger movable between a first position and a second position, the switch trigger inhibiting electrical communication between the battery and the electric motor while the switch trigger is in the first position, the switch trigger operating a switch to provide electrical communication between the electric motor and the battery while the switch trigger is in the second position; and a lock actuator movable between a locked position and an unlocked position, the lock actuator positioned in the locked position while no battery is positioned in the battery receptacle, the lock actuator preventing movement of the switch trigger to the second position while the lock actuator is in the locked position, the lock actuator positioned in the unlocked position while a battery is positioned in the battery receptacle and permitting movement of the switch trigger to the second position.

19. The power tool of claim 18, wherein, while the lock actuator is in the locked position, the lock actuator partially extends within the battery receptacle in the locked position, and the lock actuator is configured to engage the battery while the battery is positioned in the battery receptacle.

20. The power tool of claim 18, wherein while the lock actuator is in the locked position, the lock actuator biases the switch trigger toward the receptacle, and while the lock actuator is in the unlocked position, the lock actuator is spaced apart from the switch trigger to permit movement of the switch trigger.

* * * * *